US009855603B2

(12) United States Patent
Kellezi et al.

(10) Patent No.: US 9,855,603 B2
(45) Date of Patent: Jan. 2, 2018

(54) MATERIAL WITH HIGH RESISTANCE TO WEAR

(71) Applicant: BOEHLER EDELSTAHL GMBH & CO. KG, Kapfenberg (AT)

(72) Inventors: Gert Kellezi, Leoben (AT); Devrim Caliskanoglu, Giessen (DE)

(73) Assignee: Boehler Edelstahl GmbH & Co. KG, Kapfenberg (AT)

( * ) Notice: Subject to any disclaimer, the term of this patent is extended or adjusted under 35 U.S.C. 154(b) by 1153 days.

(21) Appl. No.: 13/888,862

(22) Filed: May 7, 2013

(65) Prior Publication Data

US 2013/0343944 A1 Dec. 26, 2013

(30) Foreign Application Priority Data

May 8, 2012 (EP) ..... 12450026

(51) Int. Cl.
*B22F 3/24* (2006.01)
*C22C 33/02* (2006.01)
(Continued)

(52) U.S. Cl.
CPC ..... *B22F 3/24* (2013.01); *B22F 3/15* (2013.01); *C21D 6/02* (2013.01); *C22C 33/0285* (2013.01);
(Continued)

(58) Field of Classification Search
CPC ..... B22F 3/24; B22F 3/15; B22F 2003/248; B22F 2998/10; B22F 9/082;
(Continued)

(56) References Cited

U.S. PATENT DOCUMENTS 7,615,123 B2 11/2009 Kajinic et al.
2001/0022945 A1 9/2001 Wilmes
(Continued)

FOREIGN PATENT DOCUMENTS

CN 1560307 A 1/2005
JP 2006-256915 9/2006
(Continued)

OTHER PUBLICATIONS

Roberts, G. A., Richard Kennedy, and George Krauss. "Chapter 3: Manufacture of Tool Steels." Tool Steels (5th Ed.). ASM International, 1998. 38.*

(Continued)

*Primary Examiner* — Colleen Dunn
*Assistant Examiner* — Anthony Liang
(74) *Attorney, Agent, or Firm* — Rankin, Hill & Clark LLP

(57) ABSTRACT

Material and method for the production of material with isotropic, mechanical properties and improved wear resistance and high hardness potential. Method includes producing in a powder metallurgical (PM) method a slug or ingot from a material of ledeburite tool steel alloy, and subjecting one of the slug or ingot or a semi-finished product produced from the slug or ingot to full annealing at a temperature of over 1100° C., but at least 10° C. below the fusing temperature of the lowest melting structure phase with a duration of over 12 hrs. In this manner, an average carbide phase size of the material is increased by at least 65%, a surface shape of the material is rounded and a matrix is homogenized. Method further includes subsequently processing the material into thermally tempered tools with high wear resistance occurs or into parts to which abrasive stress is applied.

4 Claims, 6 Drawing Sheets

| Designation | C | Si | Mn | Cr | Mo | W | V | Co | Fe + inp. el. |
|---|---|---|---|---|---|---|---|---|---|
| S500 | 1.08 | 0.25 | 0.28 | 5.0 | 9.5 | 3.5 | 1.35 | 8.0 | remain. |
| S599 | 1.14 | 0.22 | 0.29 | 2.8 | 9.5 | 1.5 | 3.7 | 9.0 | remain. |

Tab. 1: Chemical composition of tested materials

| Designation | C | Si | Mn | Cr | Mo | W | V | Co | Fe + inp. el. | MgC % by vol. | MC % by vol. |
|---|---|---|---|---|---|---|---|---|---|---|---|
| S500 | 0.74 | 0.28 | 0.3 | 3.9 | 5.3 | 0.2 | 0.5 | 8.07 | remain. | 8.44 | 3.44 |
| S599PM-H | 0.93 | 0.28 | 0.28 | 3.8 | 5.6 | 2.5 | 0.6 | 10 | remain. | 6.4 | 2.6 |

Tab. 2: Chemical composition of the matrix of comparison alloy S500 (AISI type M42) and of material S599PM-H according to the invention

(51) Int. Cl.

| | |
|---|---|
| ***B22F 3/15*** | (2006.01) |
| ***C21D 6/02*** | (2006.01) |
| *C21D 6/00* | (2006.01) |

(52) U.S. Cl.
CPC ..... *B22F 2003/248* (2013.01); *B22F 2998/10* (2013.01); *C21D 6/002* (2013.01); *C21D 2211/004* (2013.01); *C21D 2211/007* (2013.01); *C21D 2241/02* (2013.01)

(58) Field of Classification Search
CPC ..... C21D 2211/004; C21D 2211/007; C21D 2241/02; C21D 6/002; C21D 6/005; C21D 6/008; C22C 33/02; C22C 33/0285; C22C 33/0221; C22C 33/0207; C22C 33/0257; C22C 33/0264; C22C 33/0278
See application file for complete search history.

(56) References Cited

U.S. PATENT DOCUMENTS

| | | | |
|---|---|---|---|
| 2007/0056657 | A1 | 3/2007 | Kajinic |
| 2009/0010795 | A1 | 1/2009 | Tidesten et al. |
| 2009/0257903 | A1 † | 10/2009 | Sundin |
| 2011/0002807 | A1 | 1/2011 | Saitoh et al. |

FOREIGN PATENT DOCUMENTS

| | | | | |
|---|---|---|---|---|
| WO | 86/04360 | A1 † | 7/1986 | |
| WO | WO2007021243 | | 2/2007 | |
| WO | WO 2007021243 | A1 * | 2/2007 | ..... B22F 3/15 |

OTHER PUBLICATIONS

European Search Report issued in counterpart European Application No. 12 45 0026.
Espacenet bibliographic data for CN1560307 dated Jan. 5, 2005, one page.
Espacenet bibliographic data for JP2006256915 dated Sep. 28, 2006, one page.

* cited by examiner
† cited by third party

| Designation | C | Si | Mn | Cr | Mo | W | V | Co | Fe + Imp. el. |
|---|---|---|---|---|---|---|---|---|---|
| S 500 | 1.08 | 0.25 | 0.28 | 3.8 | 9.5 | 1.5 | 1.18 | 8.0 | remain. |
| S 599 | 1.13 | 0.22 | 0.29 | 3.8 | 6.5 | 5.0 | 2.1 | 9.0 | remain. |

Tab. 1: Chemical composition of tested materials

| Designation | C | Si | Mn | Cr | Mo | W | V | Co | Fe + Imp. el. | $M_6C$ % by vol. | MC % by vol. |
|---|---|---|---|---|---|---|---|---|---|---|---|
| S 500 | 0.74 | 0.29 | 0.3 | 3.9 | 5.1 | 0.7 | 0.5 | 8.97 | remain. | 8.44 | 1.44 |
| S 599PM-H | 0.63 | 0.28 | 0.28 | 3.8 | 3.8 | 2.5 | 0.6 | 10 | remain. | 6.4 | 2.9 |

Tab. 2: Chemical composition of the matrix of comparison alloy S500 (AISI type M42) and of material S599PM-H according to the invention

S599PM-H

S599PM

S599PM-H

S500

MATERIAL WITH HIGH RESISTANCE TO WEAR

CROSS-REFERENCE TO RELATED APPLICATIONS

The present application claims priority under 35 U.S.C. §119(a) of European Patent Application No. 12 450 026.5, filed May 8, 2012, the disclosure of which is expressly incorporated by reference herein in its entirety.

BACKGROUND OF THE EMBODIMENTS

1. Field of the Invention

Embodiments of the invention relate to a production of ledeburite tool steels by a powder metallurgical (PM) method, in which PM materials have isotropic, mechanical properties, improved wear resistance and high hardness potential.

2. Discussion of Background Information

Highly alloyed tool steels, which due to their composition solidify ledeburitically, often have locally in the casting state coarse carbides and carbide clusters in the structure which align themselves in band form during a heat deformation of the cast ingot and ultimately form carbide bands dependent on the deformation direction or form a deformation structure. This crystalline structure determines anisotropic property features of the material with respect to the particular direction of stress on the part.

In order to achieve isotropic and improved material properties of highly alloyed tool steels, it is known to apply a powder metallurgical production method which ensures a homogenous distribution of small carbides in the matrix.

In a PM method, there occurs a separating of liquid steel by high-speed streams of gas into small droplets which solidify at a high rate and thereby form fine carbide phases in these. By a subsequent Hot Isostatic Pressing (HIP) of the powder in a capsule, a HIP ingot is produced by sintering which is heat-transformable and advantageously at least has a homogenous distribution of small carbide phases in the material.

Materials produced in this manner are in their mechanical properties to the greatest possible extent isotropic and have good workability but have a reduced hardness potential as a result of the matrix structure. For a person skilled in the art, the term hardness potential refers to the extent of the hardness increase during the annealing of a material that is transformed martensitically from the austenite structure region and has retained austenite.

Furthermore, as was found, PM materials can by comparison be slightly less wear resistant for an identical chemical composition of the alloy, even though equally high carbide phase quantities are present in the matrix during a conventional production.

SUMMARY OF THE EMBODIMENTS

Accordingly, embodiments of the invention are directed to a method of the type generally discussed above in which an improved wear resistance and an increased hardness potential are imparted to PM materials under retention of an isotropy of the mechanical properties.

Furthermore, embodiments of the invention are directed to creating a powder metallurgically produced material from a ledeburite tool steel alloy with high hardness potential and high resistance to abrasive wear.

According to embodiments of the invention, in a production of ledeburite machine steel alloys according to the PM method, a HIP ingot and/or a semi-finished product made from the HIP ingot is subjected to a full annealing at a temperature of over 1100° C., but at least 10° C. below the fusing temperature of the lowest melting structure phase with a duration of over 12 hrs. In this manner, the average carbide phase size of the material is increased by at least 65%, the surface shape of the material is rounded and the matrix homogenized. Subsequently, a further processing of the material into tools with high wear resistance occurs or into parts to which abrasive stress is applied.

The method according to the embodiments has the advantages that the carbide phases are enlarged at temperatures above 1100° C. because of diffusion and a homogenization of the matrix occurs. In the non-hardened state of the material, the strength properties roughly remain the same and the elongation at fracture and in particular the area reduction at fracture are increased, resulting in processing and property advantages.

If parts are worked and/or processed after a full annealing with intervals of time according to the invention, then a susceptibility to cracking also under high material stresses, in particular tensile stress, is significantly reduced.

During a thermal tempering by hardening and annealing of highly alloyed material produced according to the invention, high annealing hardness values are already achieved at low hardening temperatures.

Furthermore, it was surprising to find that, for identical carbide phase quantities but considerably increased carbide phase size, for example of 84%, fully annealed and tempered PM materials show in the standard-compliant abrasion test a substantially improved, possibly by more than 30%, wear resistance when compared with standard samples of the same production without full annealing.

The advantages of the invention can be achieved particularly distinctively if a high speed steel material with a chemical composition in percent by weight of:

| | |
|---|---|
| Carbon (C) | 0.8 to 1.4 |
| Chromium (Cr) | 3.5 to 5.0 |
| Molybdenum (Mo) | 0.1 to 10.0 |
| Vanadium (V) | 0.8 to 10.5 |
| Tungsten (W) | 0.1 to 10.0 |
| Cobalt (Co) | 1.0 to 12.0 |

and Si, Mn, S, N and alternatively Ni, Al, Nb, Ti and impurities and balance iron are used as a tool steel alloy. The carbon content of the matrix is set to 0.45 to 0.75 and the average carbide phase diameter in this is set to greater than 2.8 μm.

In the above tool steel alloy, the contents of carbon, of important carbide producers and of the element cobalt, which is particularly conducive to the matrix strength and hot hardness, as well as the carbon concentration of the matrix are specified within limits which, as the materials tests have shown, are essential for the method, such that an advantageous carbide phase diameter according to the embodiments is set.

Comparatively coarse carbide phase diameters of this type are also retained in the structural compound under harsh, abrasive stresses, or they are not discharged or dissolved out, because the matrix containing these hard phases had property features advantageous therefor imparted to it by the full annealing.

The method according to the invention can also be applied in an advantageous manner for a cold work steel material with a chemical composition in percent by weight of:

| | |
|---|---|
| Carbon (C) | 1.0 to 3.0 |
| Chromium (Cr) | to 12.0 |
| Molybdenum (Mo) | 0.1 to 5.0 |
| Vanadium (V) | 0.8 to 10.5 |
| Tungsten (W) | 0.1 to 3.0 |

and Si, Mn, S, N and alternatively Ni, Al, Nb, Ti and impurities and balance iron.

Further embodiments are directed to a material having isotropic, mechanical properties and having in the thermally tempered state a carbide phase proportion of $M_6C$ carbides and MC carbides of at least 7.0 percent by volume at an average carbide phase size of over 2.8 μm in a matrix that has a carbon concentration of (0.45 to 0.75) percent by weight.

A carbide phase proportion of equal size has, as was found, a wear-reducing effect if an increased average carbide phase size is present in a homogenous matrix.

According to the prior art, it has up to now been attempted to set carbide phases using the smallest possible size in the material in order to improve or to optimize the property features thereof altogether.

It was surprisingly discovered, however, that increased average carbide phase sizes in the matrix homogenized by full annealing cause a substantially improved wear resistance of the material.

This improvement is not yet fully resolved scientifically; however, it is assumed by the Applicant that under a wear stress the coarser carbides delay a critical decrease in size of the compound surfaces or bonding surfaces in the homogenous matrix, and that the homogenized matrix has larger bonding potentials to the coalesced, coarser carbide.

The improvements in wear resistance are particularly marked for materials which have a chemical composition in percent by weight of:

| | |
|---|---|
| Carbon (C) | 0.8 to 1.4 |
| Chromium (Cr) | 3.5 to 5.0 |
| Molybdenum (Mo) | 0.1 to 10.0 |
| Vanadium (V) | 0.8 to 10.5 |
| Tungsten (W) | 0.1 to 10.0 |
| Cobalt (Co) | 1.0 to 12.0 |

and Si, Mn, S, N and alternatively Ni, Al, Nb, Ti and impurities and balance iron, and carbide phases, namely 5.5 to 8.5 percent by volume $M_6C$ carbides and 1.5 to 3.9 percent by volume MC carbides, with a rounded surface shape are intercalated in the matrix.

It is thereby advantageous and conducive to the level of the mechanical properties if the material has a percent by weight content of at least one element of:

| | | | |
|---|---|---|---|
| Si = | 0.1 to 0.5, | preferably | 0.15 to 0.3 |
| P = | max. 0.03, | preferably | max. 0.02 |
| S = | max. 0.3, | preferably | max. 0.03 |
| N = | max. 0.1, | preferably | max. 0.08 |

If the material has a percent by weight concentration of at least one element of

| | | | |
|---|---|---|---|
| C = | 0.9 to 1.4, | preferably | 1.0 to 1.3 |
| Mn = | 0.15 to 0.5, | preferably | 0.2 to 0.35 |
| Cr = | 3.0 to 5.0, | preferably | 3.5 to 4.5 |
| Mo = | 3.0 to 10.0 | | |
| W = | 1.0 to 10.0 | | |
| Mo + W/2 = | 6.5 to 12.0, | preferably | 7.0 to 11.0 |
| V = | 0.9 to 6.0, | preferably | 1.0 to 4.5 |
| Co = | 7.0 to 11.0, | preferably | 8.0 to 10.0 |

an optimization of the property parameters thereof with respect to necessary specific stresses can occur.

For cold work steels, which are to withstand the highest stresses in abrupt operation with the aforementioned advantages, it is advantageous if the material has a chemical composition in percent by weight of

| | |
|---|---|
| Carbon (C) | 0.8 to 3.0 |
| Chromium (Cr) | to 12.0 |
| Molybdenum (Mo) | 0.1 to 5.0 |
| Vanadium (V) | 0.8 to 10.5 |
| Tungsten (W) | 0.1 to 3.0 |

and Si, Mn, S, N and alternatively Ni, Al, Nb, Ti and impurities and balance iron.

Embodiments of the invention are directed to a method for the production of materials with isotropic, mechanical properties and improved wear resistance and high hardness potential. The method includes producing in a powder metallurgical (PM) method a slug or ingot from a material of ledeburite tool steel alloy, and subjecting one of the slug or ingot or a semi-finished product produced from the slug or ingot to full annealing at a temperature of over 1100° C., but at least 10° C. below the fusing temperature of the lowest melting structure phase with a duration of over 12 hrs. In this manner, an average carbide phase size of the material is increased by at least 65%, a surface shape of the material is rounded and a matrix is homogenized. The method further includes subsequently processing the material into thermally tempered tools with high wear resistance occurs or into parts to which abrasive stress is applied.

According to embodiments, the PM method includes nozzle atomizing a liquid metal into an alloy powder using nitrogen; and hot isostatic pressing (HIP) of the alloy powder. The slug or ingot is a HIP slug or ingot.

In accordance with other embodiments, the tool steel alloy may include a high speed steel with a chemical composition in percent by weight of:

| | |
|---|---|
| Carbon (C) | 0.8 to 1.4 |
| Chromium (Cr) | 3.5 to 5.0 |
| Molybdenum (Mo) | 0.1 to 10.0 |
| Vanadium (V) | 0.8 to 10.5 |
| Tungsten (W) | 0.1 to 10.0 |
| Cobalt (Co) | 1.0 to 12.0 |

and Si, Mn, S, N and impurities and balance iron. A carbon content of the matrix can be set to 0.45 to 0.75 and an average carbide phase diameter in the matrix may be set to greater than 2.8 μm. Advantageously, the average carbide phase diameter in the matrix can be set to greater than 3.2 μm. Further, the chemical composition in percent by weight of the high speed steel may further include Ni, Al, Nb, Ti.

In embodiments, the tool steel alloy may include a cold work steel material with a chemical composition in percent by weight of:

| | |
|---|---|
| Carbon (C) | 1.0 to 3.0 |
| Chromium (Cr) | to 12.0 |
| Molybdenum (Mo) | 0.1 to 5.0 |
| Vanadium (V) | 0.8 to 10.5 |
| Tungsten (W) | 0.1 to 3.0 |

and Si, Mn, S, N and impurities and balance iron is used as a tool steel alloy. The chemical composition of the cold work steel material may further include Ni, Al, Nb, Ti.

Embodiments of the instant invention are directed to a material with high resistance to abrasive wear produced by the above-discussed method from ledeburite tool steel alloy. The material has isotropic, mechanical properties and, in a thermally tempered state, a carbide phase proportion of M6C and MC of at least 7.0 percent by volume at an average carbide phase size of over 2.8 μm in a matrix having a carbon concentration of (0.45 to 0.75) percent by weight.

According to embodiments of the invention, a chemical composition in percent by weight of the material can include:

| | |
|---|---|
| Carbon (C) | 0.8 to 1.4 |
| Chromium (Cr) | 3.5 to 5.0 |
| Molybdenum (Mo) | 0.1 to 10.0 |
| Vanadium (V) | 0.8 to 10.5 |
| Tungsten (W) | 0.1 to 10.0 |
| Cobalt (Co) | 1.0 to 12.0 |

and Si, Mn, S, N and impurities and balance iron. The material can also have carbide phases of 5.5 to 8.5 percent by volume M6C carbides and 1.5 to 3.9 percent by volume MC carbides, and a rounded surface shape intercalated in the matrix. Further, the chemical composition of the material may further include Ni, Al, Nb, Ti.

In accordance with still other embodiments, the material can include at least one of:

Si having a percent by weight content of 0.1-0.5;
P having a maximum percent by weight content of 0.03;
S having a maximum percent by weight content of 0.3; and
N having a maximum percent by weight content of 0.1.

According to still other embodiments, the material may include at least one of:

Si having a percent by weight content of 0.15-0.3;
P having a maximum percent by weight content of 0.02;
S having a maximum percent by weight content of 0.3; and
N having a maximum percent by weight content of 0.08.

In further embodiments of the invention, the material can include at least one of:

C having a percent by weight content of 0.9-1.4;
Mn having a percent by weight content of 0.15-0.5;
Cr having a percent by weight content of 3.0-5.0;
Mo having a percent by weight content of 3.0-10.0;
W having a percent by weight content of 1.0-10.0;
Mo+W/2 having a percent by weight content of 6.5-12.0;
V having a percent by weight content of 0.9-6.0; and
Co having a percent by weight content of 7.0-11.0.

In accordance with still further embodiments, the material may include at least one of:

C having a percent by weight content of 1.0-1.3;
Mn having a percent by weight content of 0.2-0.35;
Cr having a percent by weight content of 3.5-4.5;
Mo having a percent by weight content of 3.0-10.0;
W having a percent by weight content of 1.0-10.0;
Mo+W/2 having a percent by weight content of 7.0-11.0;
V having a percent by weight content of 1.0-4.5; and
Co having a percent by weight content of 8.0-10.0.

In accordance with still yet other embodiments of the present invention, the material can have a chemical composition of:

Carbon (C) having a percent by weight of 0.8-3.0;
Chromium (Cr) having a percent by weight of up to 12.0
Molybdenum (Mo) having a percent by weight of 0.1-5.0;
Vanadium (V) having a percent by weight of 0.8-10.5;
Tungsten (W) having a percent by weight of 0.1-3.0; and
Si, Mn, S, N and impurities and balance iron. Further, the chemical composition of the material can further include Ni, Al, Nb, Ti.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

Tab. 1 shows the chemical composition of tested materials;

Figure 1:
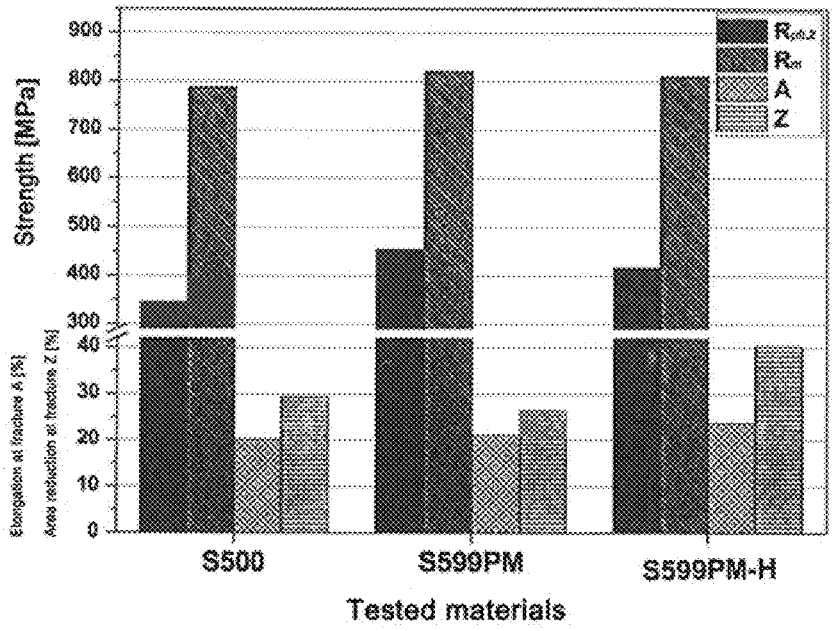
Figure 2:
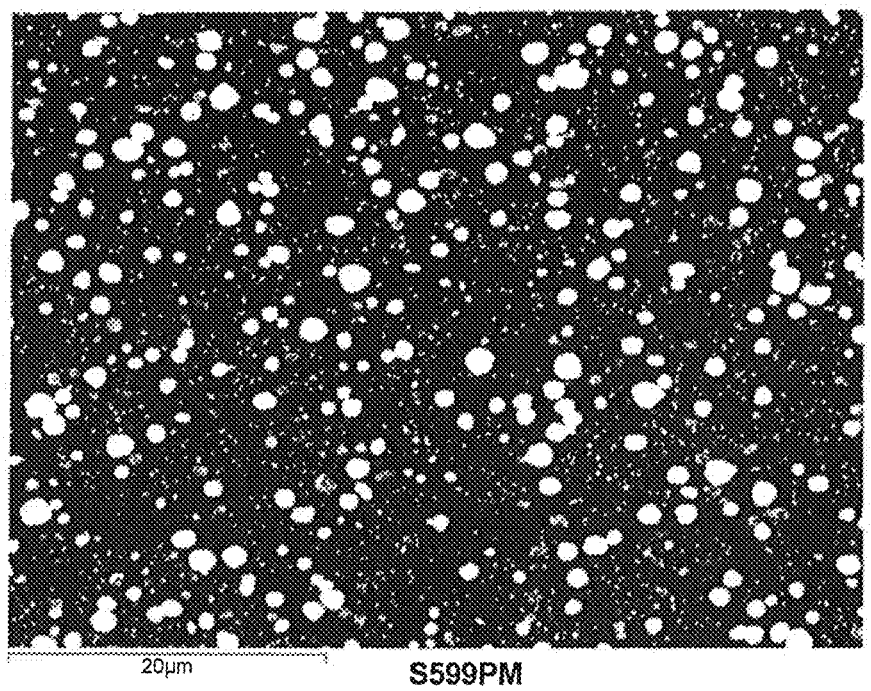
Figure 3:
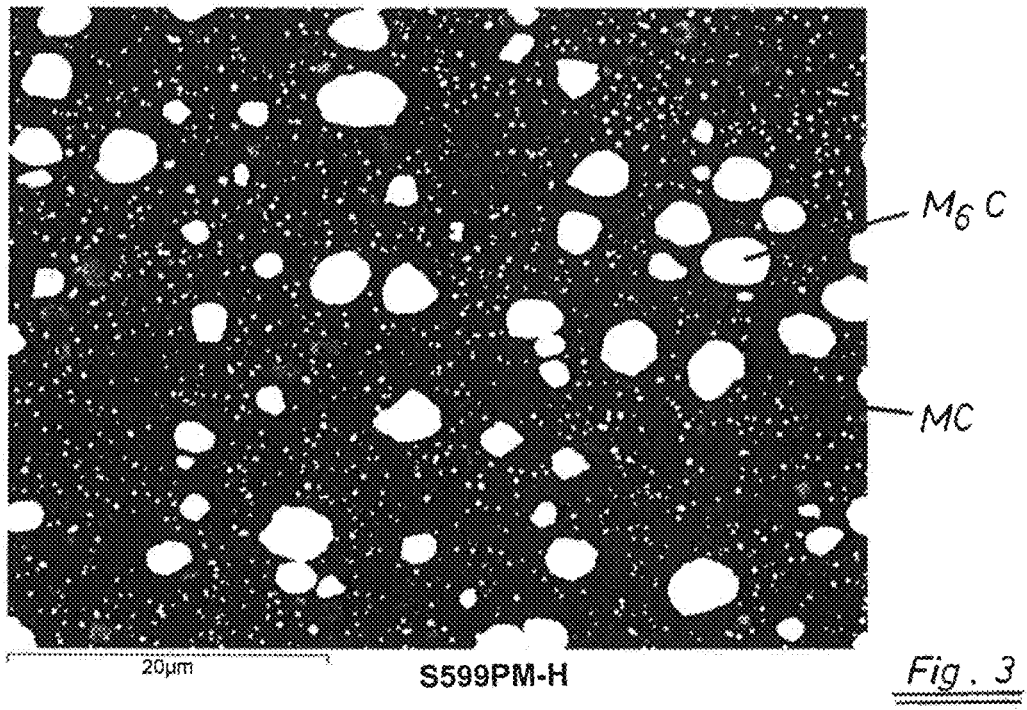
Figure 4:
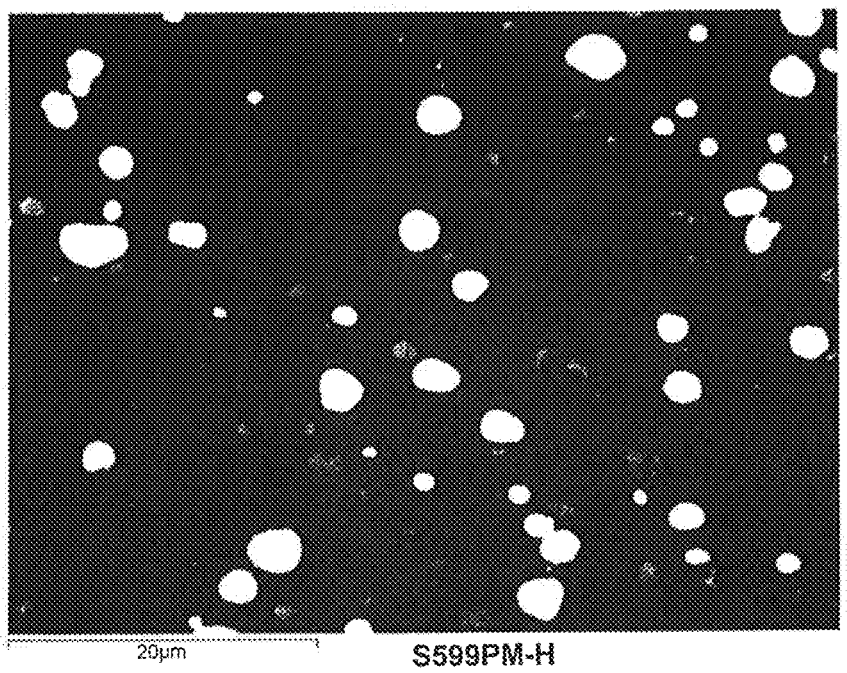
Figure 5:
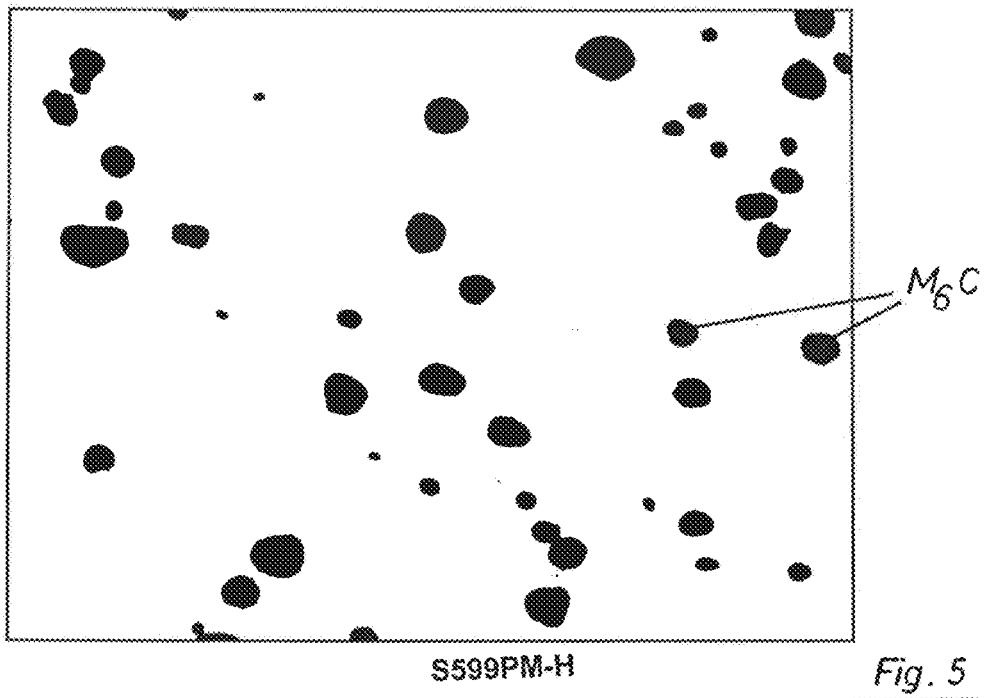
Figure 6:
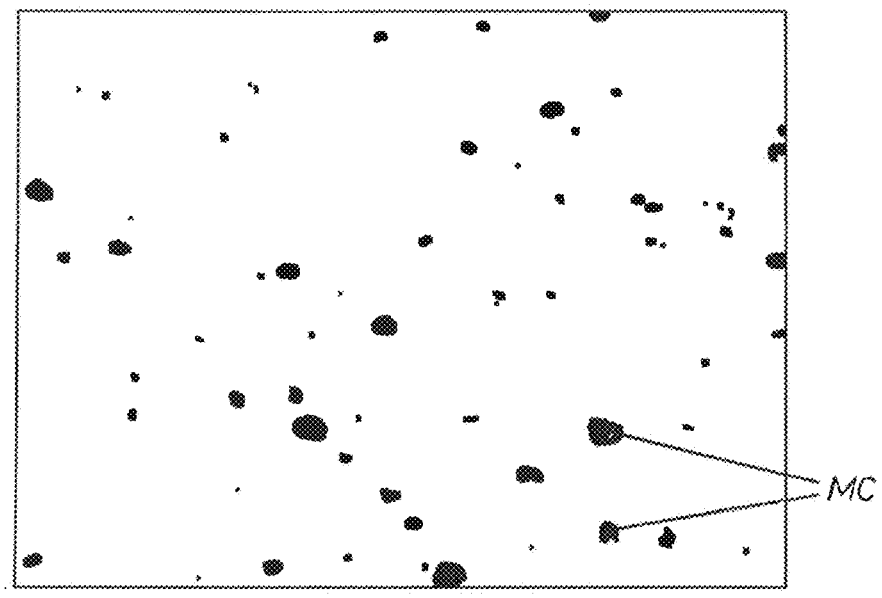
Figure 7:
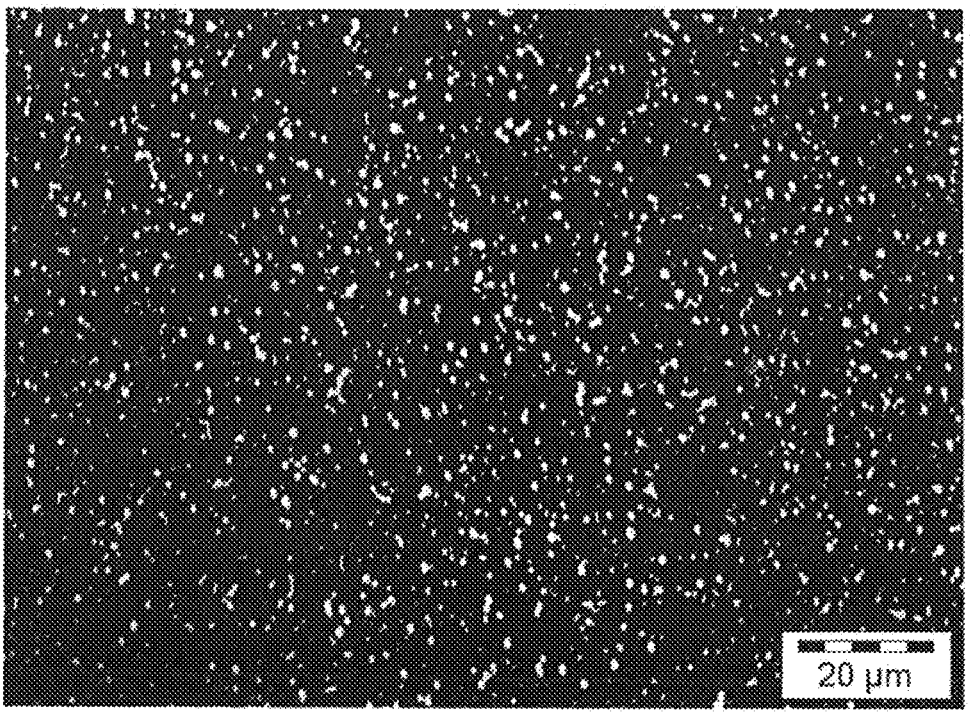
Figure 8:
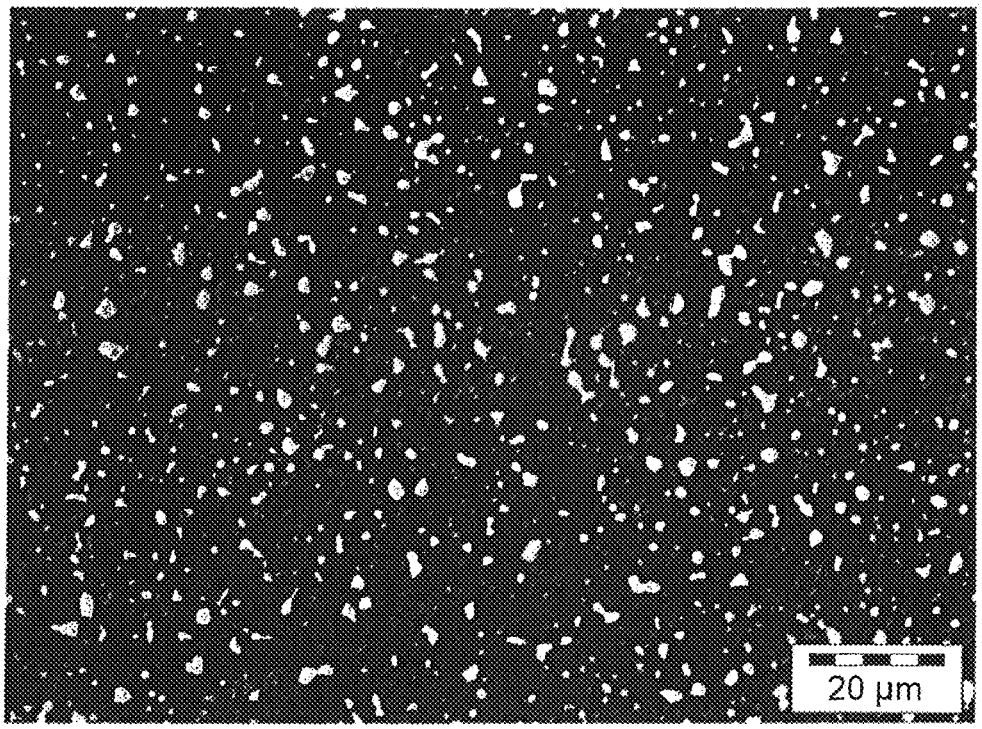
Figure 9:
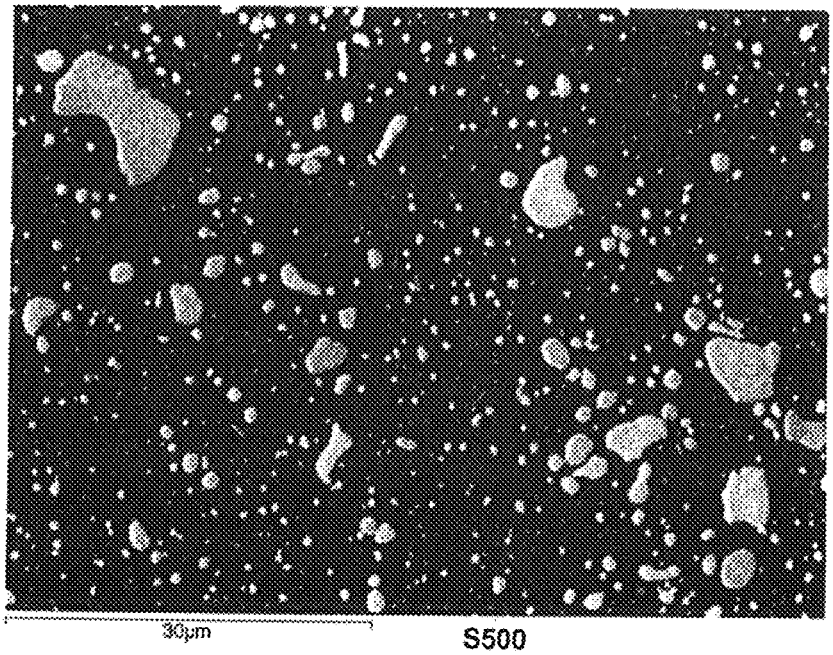
Figure 10:
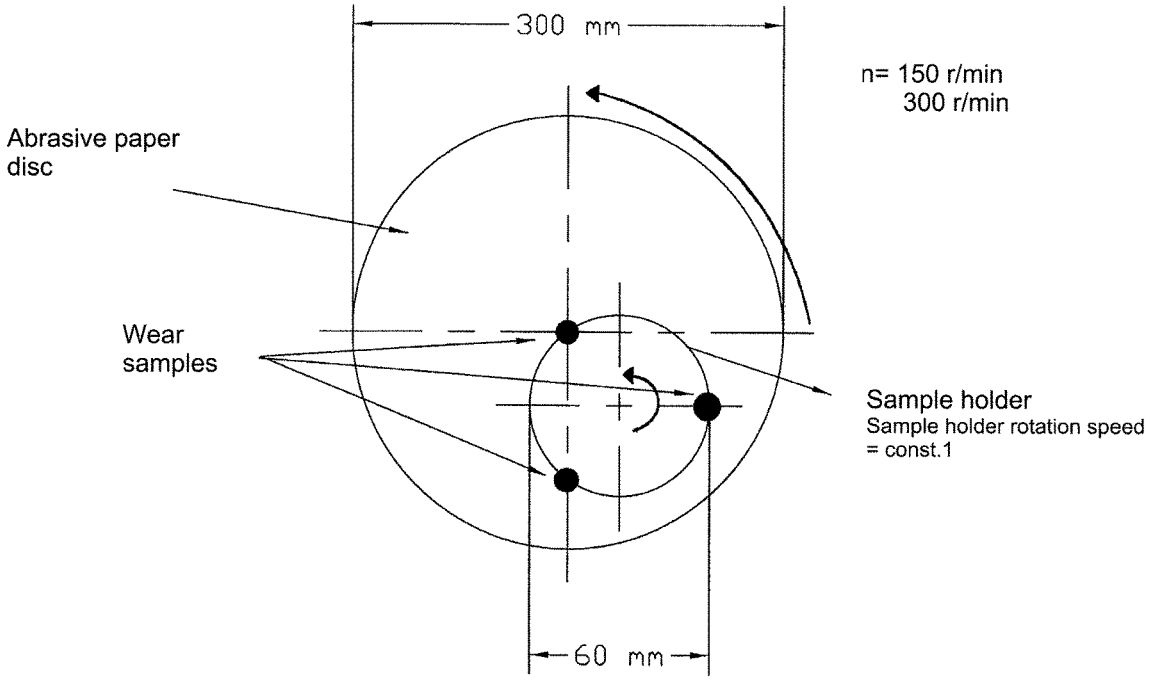

Tab. 2 shows the chemical composition of the matrix of the comparison alloy and of the material according to the invention (S599PM-H);

FIG. 1 shows mechanical properties of the materials;

FIG. 2 shows carbide phases in the PM material (S599PM) produced according to the prior art (SEM analysis);

FIG. 3 shows carbide phases in the PM material (S599PM-H) produced according to the invention (SEM analysis);

FIG. 4 shows carbide phases in the material according to the invention (S599PM-H) (SEM analysis);

FIG. 5 shows the $M_6C$ phase from FIG. 4;

FIG. 6 shows the MC phase from FIG. 4;

FIG. 7 shows a phase image of a PM material (S599PM) according to the prior art, tempered;

FIG. 8 shows a phase image of a PM material (S599PM-H) produced according to the invention, tempered;

FIG. 9 shows a phase image of a cast and deformed material (S500);

FIG. 10 shows a device for testing the wear performance (schematic).

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The micrographs shown in FIGS. 3 and 4 result from scanning electron microscope (SEM) analyses using a scanning electron microscope SEM model: JEOL JSM 6490 HV, and the micrographs shown in FIGS. 5 and 6 result from using scanning electron microscope EDX model: Oxford Instrument sinca-Pentafet x3 Si (Li) 30 $mm^2$.

The $M_6C$ and MC carbide phases were created by carbide phase selection using the image processing software: Image J.

From Tab. 1, the chemical composition of a standard alloy (AISI type M42) with the designation S500 and that of a powder metallurgically produced material S599PM as well as that of a material S599PM-H (see Tab. 2) according to embodiments of the invention can be recognized.

The material with the designation S500 served as a comparison material of typical manufacture, because this has good wear properties according to the prior art.

The alloy corresponding to the composition designated as S599 was smelted, and an HIP ingot was produced from this according to the PM method, turning the molten mass into powder by nozzle atomization using nitrogen—filling a capsule with this powder and hot isostatic pressing of the capsule.

One part of this HIP ingot was processed in a customary manner into samples and tools with the designation S599-PM.

On the second part of the ingot material from the same molten mass, a full annealing according to embodiments of the invention occurred on the semi-finished product with a square cross section of 100 mm at 1180° C. with a duration of 24 hours, and a subsequent further processing of the material with the designation S599PM-H occurred.

Tab. 2 illustrates the chemical composition of the matrix and the portions of carbide phases in the comparison material S500 and in the material S599PM-H produced according to embodiments of the invention.

In FIG. 1, the mechanical properties, such as elongation limit $R_{P0.2}$, tensile strength Rm, elongation at fracture A and area reduction at fracture Z, of the materials 5500, S599PM and S599PM-H are shown in a bar graph.

As a result of the full annealing according to embodiments of the invention, the elongation A and the area reduction Z of the material S599PM-H are clearly increased, which is caused by a homogenization of the matrix.

FIG. 2 shows in micrograph a material S599PM in the soft-annealed state with carbide phases of the type $M_6C$ and MC in the matrix. The phase size of the carbides is on average approx. 2.0 μM.

The fine $M_{23}C_6$ carbides are not included in the evaluation of the material with a hardness of approx. 258 HB.

FIG. 3 shows in micrograph the material S599PM-H, which was produced according to the embodiments of invention. At identical carbide phase proportions, the carbides are significantly coarsened and have an average diameter of approx. 4.0 μm.

In the matrix with a hardness of approx. 254 HB, fine $M_{23}C_6$ carbides are again intercalated because the material is present in the soft-annealed state.

FIG. 4 shows a material S599PM-H produced according to embodiments of the invention in an SEM analysis (scanning electron microscope), which is tempered to a hardness of 68.7 HRC.

With respect to FIG. 4 and FIG. 5, it should also be noted that the $M_{23}C_6$ carbides no longer appear in the image after a tempering.

In FIG. 5, the carbide phases of the type $M_6C$, selected using an aforementioned image program, can be seen.

The $M_6C$ carbide phase proportion is approx. 7.4 percent by volume, wherein this value resulted from more than 6 measurements as a mean value.

In FIG. 6, the carbide phases of the type MC are illustrated from the testing of the tempered material with a proportion of approx. 1.8 percent by volume, wherein the mean value was likewise calculated from more than 6 measurements.

FIG. 7 shows in a micrograph (polished, solvent-etched using 3% HNO3) a powder metallurgically produced material S599 PM in the thermally tempered state having a homogenous distribution of the fine carbides with a medium carbide phase size of 1.6 μm. The material hardness is approx. 68.2 HRC.

In FIG. 8, the same material, which is tempered using identical parameters, which however was subjected to a full annealing according to embodiments of the invention, is shown in micrograph. The measurements of the medium carbide phase size yielded a value of 3.6 μm.

FIG. 9 shows the structure of a material S500 produced using a cast ingot in micrograph in the annealed state with a hardness of 239 HB. The material has angular, coarser carbide phases arranged slightly bandwise.

Tests concerning the wear performance of the materials occurred by a device which is illustrated schematically in FIG. 10.

In the abrasion wear test, samples on a disc which had a diameter of 300 mm and was fitted with SiC abrasive paper P120 were pressed on using a contact force per sample of 13.33 N, which corresponded to a surface pressure of 0.265 $N/mm^2$. The rotation speed of the disc was 150 and 300 $min^{-1}$.

The results of the abrasion wear test of tempered samples from respectively 12 tests were valued at 100% for the comparison material 5500.

The powder metallurgically produced tempered material S599PM of the same type with fine carbide phases exhibited by comparison a wear rate of approx. 98%.

The tests of the material S599PM-H, which was treated according to embodiments of the invention using full annealing during production and produced under the same tempering parameters, exhibited an increase in wear resistance of 33% to approx. 130% of the value of S500 and S599PM.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method for the production of materials with isotropic mechanical properties and improved wear resistance and high hardness potential, comprising:

producing in a powder metallurgical method a slug or ingot from a material of ledeburite tool steel alloy;

subjecting one of the slug or ingot or a semi-finished product produced from the slug or ingot to a temperature treatment comprising a full annealing at a temperature of over 1100° C. but no higher than 1180° C. for a duration of over 12 hours but no longer than 24 hours, and subsequently, processing the material into thermally tempered tools with high wear resistance or into parts to which abrasive stress is applied, wherein a tool steel alloy has a chemical composition in percent by weight of:

| | |
|---|---|
| carbon | 1.0 to 3.0 |
| chromium | up to 12.0 |
| molybdenum | 0.1 to 5.0 |
| vanadium | 0.8 to 10.5 |
| tungsten | 0.1 to 3.0 |

and Si, Mn, S, or N and impurities and balance iron, and is devoid of Ni, Al, Nb and Ti.

2. The method according to claim 1, wherein the powder metallurgical method comprises:

nozzle atomizing a liquid metal alloy into a powder of the alloy using nitrogen; and hot isostatic pressing of the alloy powder, wherein the slug or ingot is a hot isostatic pressing slug or ingot.

3. The method according to claim 1, wherein a carbon content of the matrix is set to 0.45 wt % to 0.75 wt % and an average carbide phase diameter in the matrix is set to greater than 2.8 microns.

4. The method according to claim 1, wherein the average carbide phase diameter in the matrix is set to greater than 3.2 microns.

* * * * *